US007521674B2

(12) United States Patent
Pau

(10) Patent No.: US 7,521,674 B2
(45) Date of Patent: Apr. 21, 2009

(54) METHOD FOR TRAPPING UNCHARGED MULTI-POLE PARTICLES

(75) Inventor: Stanley Pau, Hoboken, NJ (US)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 0 days.

(21) Appl. No.: 11/897,747

(22) Filed: Sep. 1, 2007

(65) Prior Publication Data

US 2007/0295896 A1 Dec. 27, 2007

Related U.S. Application Data

(62) Division of application No. 11/089,892, filed on Mar. 25, 2005, now Pat. No. 7,276,689.

(51) Int. Cl.
*H01J 40/00* (2006.01)
*H01J 47/00* (2006.01)

(52) U.S. Cl. ..... 250/305; 250/290; 250/291; 250/292; 250/281; 250/282; 250/283; 250/396; 250/396 R; 250/397; 250/398; 250/399; 250/400; 250/251; 315/500; 315/501; 315/502; 315/503; 315/504; 315/505; 315/506; 315/507

(58) Field of Classification Search ..... 250/305, 250/290–292, 281–283, 396–400, 251, 396 R; 315/500–507

See application file for complete search history.

(56) References Cited

U.S. PATENT DOCUMENTS 2,939,952 A 6/1960 Paul et al. ..... 250/41.9
6,469,298 B1 * 10/2002 Ramsey et al. ..... 250/292
6,710,334 B1 * 3/2004 Twerenbold ..... 250/286
6,805,779 B2 * 10/2004 Chistyakov ..... 204/298.36
7,276,689 B2 * 10/2007 Pau ..... 250/292
2006/0219898 A1 * 10/2006 McLuckey et al. ..... 250/288

OTHER PUBLICATIONS

Attached are Two IDS's Cited by Applicant in the Parent Application, U.S. Appl. No. 11/089,892, filed on Mar. 25, 2005 and a "Notice of References Cited" Submitted by the Examiner in the Same Case. Pursuant to 37 CFR 1.98(d)(1).

L. Pauling et al., "The van der Waals . . . ," *Phys. Rev.*, vol. 47, pp. 686-692 (May 1935).

J. D. Jackson, "Classical Electrodynamics," 2nd ed., p. 164, John Wiley & Sons, New York (1975).

C. C. Bradley et al., "Laser Cooling . . . ," Ch. 8, *Experimental Methods in the Physical Sciences*, vol. 29B, pp. 129-144 (1996).

(Continued)

*Primary Examiner*—Jack I Berman
*Assistant Examiner*—Meenakshi S Sahu

(57) ABSTRACT

Apparatus and method for trapping uncharged multi-pole particles comprises a bound cavity for receiving the particles, and a multiplicity of electrodes coupled to the cavity for producing an electric field in the cavity. In a preferred embodiment, the electrodes are configured to produce in the electric field potential both a multi-pole (e.g., dipole) component that aligns the particles predominantly along an axis of the cavity and a higher order multi-pole (e.g., hexapole) component that forms a trapping region along the axis. In one embodiment, the electrodes and/or the particles are cooled to a cryogenic temperature.

8 Claims, 7 Drawing Sheets

OTHER PUBLICATIONS

J. M. Wells et al., "A Quadrupole Ion Trap . . . ," *Anal. Chem*. vol. 70, No. 3, pp. 438-444 (Feb. 1998).

T. A. J. Duke et al., "Microfabricated Sieve . . . ," *Phys. Rev. Lett.*, vol. 80, No. 7, pp. 1552-1555 (Feb. 1998).

R. E. March, "Quadrupole Ion Trap . . . ," *Encyclopaedia of Anal. Chem.*, pp. 11848-11872, J. Wiley & Sons Ltd., Chichester (2000).

E. R. Badman et al., "Miniature Mass Analyzers," *J. Mass Spectrom.*, vol. 35, pp. 659-671 (2000).

R. H. Austin et al., "Scanning the Controls . . . ," *IEEE Trans. Nanotech.*, vol. 1, No. 1, pp. 12-18 (Mar. 2002).

W. B. Whitten et al., "High-pressure ion trap . . . ," *Rapid Commun. Mass Spectrom.*, vol. 18, pp. 1749-1752 (2004).

M. Bazant et al., "Induced-Charge . . . ," *Phys. Rev. Lett.*, vol. 92, No. 6, pp. 066101-(1-4) (Feb. 2004).

R. E. March et al., "Practical Aspects of Ion Trap Mass Spectrometry" vol. 1, p. 33, CRC Press LLC (1995).

S. Pau, "Trapping and separating polar molecules by a hexapole trap," *Appl. Phys. Lett.*, vol. 87, No. 13, pp. 134104-(1-3) (Sep. 2005).

* cited by examiner

METHOD FOR TRAPPING UNCHARGED MULTI-POLE PARTICLES

CROSS-REFERENCE TO RELATED APPLICATIONS

This is a divisional of application Ser. No. 11/089,892 filed on Mar. 25, 2005 now U.S. Pat. No. 7,276,689.

BACKGROUND OF THE INVENTION

1. Field of the Invention

This invention relates to method for trapping uncharged multi-pole particles, and, more specifically, for trapping n-pole particles in an (n+4)-pole electric field potential.

2. Discussion of the Related Art

There are many applications in the fields of physics, biology and chemistry that require the separation and detection of molecules of different size, mass, or polarity. In a quadrupole ion trap mass spectrometer, for example, particles (e.g., atoms, molecules) are ionized, trapped inside a quadrupole potential region in a He buffer gas, and subsequently separated according to the ratio of their mass (m) to charge (q), as their orbits become unstable.

Exemplary ion traps are described, for example, by W. Paul et al. in U.S. Pat. No. 2,939,952 issued Jun. 7, 1960. One such ion trap, known as a quadrupole, is described by R. E. March in "Quadrupole Ion Trap Mass Spectrometer," *Encyclopedia of Analytical Chemistry,* R. A. Meyers (Ed.), pp. 11848-11872, John Wiley & Sons, Ltd., Chichester (2000). Both of these documents are incorporated herein by reference.

In general, however, ion traps rely on the charged nature of the particles they trap, and, as such, are incapable of trapping uncharged (i.e., electrically neutral) particles.

Thus, a need remains in the mass spectrometer art for an apparatus that is capable of trapping particles that are uncharged.

Uncharged particle detection/separation schemes, unrelated to the quadrupole ion trap technique, are known in two other fields: gas/liquid chromatography and gel electrophoresis. In a gas or liquid chromatograph a solute, combined with a carrier gas or solution, is injected into a temperature controlled column. The components migrate at different speeds depending on the interaction with the stationary phase and are detected separately at the output. On the other hand, in gel electrophoresis nucleic acids and proteins are separated by their diffusion through a gel under an applied external electric field. Recently there have been a number of reports of a micro-fabricated array of sieves on a chip to sort molecules by size and mass with the goal of making a miniaturized bioanalytical system. See, for example, R. H. Austin, et al., *IEEE Trans. Nanotech.,* Vol. 1, No. 12, pp. 12-18 (2002) and T. A. J. Duke et al., *Phys. Rev. Lett.,* Vol. 80, No. 7, pp. 1552-1555 (1998), both of which are incorporated herein by reference. These applications are also expected to benefit from alternative uncharged particle detection schemes of the type described below.

BRIEF SUMMARY OF THE INVENTION

In accordance with one aspect of our invention, apparatus for trapping uncharged multi-pole particles comprises a bound cavity for receiving the particles, and a multiplicity of electrodes coupled to the cavity for producing an electric field potential within the cavity. The electrodes are configured to produce in the electric field potential a multi-pole first component that forms a trapping region along the axis. The order of the first component is at least sixth order; that is, the component is a hexapole or a higher order component.

In accordance with another aspect of our invention, apparatus for trapping uncharged multi-pole particles comprises a bound cavity for receiving the particles, and a multiplicity of electrodes coupled to the cavity for producing an electric field potential within the cavity. The electrodes are configured to produce in the electric field potential a multi-pole first component that forms a trapping region along the axis. The apparatus also includes means for aligning the uncharged particles predominantly along a predetermined axis within the cavity. In a preferred embodiment of the aligning means, the electrodes are also configured to produce in the electric field potential a multi-pole second component that aligns the particles predominantly along the predetermined axis. In another embodiment of the aligning means, an external source of an electromagnetic field aligns the particles predominantly along the predetermined axis.

In one embodiment, the electrodes, cavity and/or the particles are cooled to a cryogenic temperature.

In accordance with yet another aspect of our invention, a method comprises the steps of (a) introducing a plurality of uncharged multi-pole particles into a bound cavity, and (b) applying oscillating voltage to the cavity to generate therein an electric field potential that includes a multi-pole component that forms a trapping region along the axis. The order of the component is at least sixth order; that is, the component is a hexapole or a higher order component.

In accordance with still another aspect embodiment of our invention, a method comprises the steps of (a) introducing a plurality of uncharged multi-pole particles into a bound cavity, (b) aligning the particles predominantly along a predetermined axis within the cavity, and (c) applying an oscillating voltage to the cavity to generate therein an electric field that includes a multi-pole component that forms a trapping region along the axis. In a preferred embodiment, step (b) includes the step of forming in the electric field potential a multi-pole, lower order second component that aligns the particles predominantly along the predetermined axis. In another embodiment, step (b) utilizes an external source to generate an electric or magnetic field within the cavity that aligns the particles predominantly along the predetermined axis.

BRIEF DESCRIPTION OF THE SEVERAL VIEWS OF THE DRAWING

Our invention, together with its various features and advantages, can be readily understood from the following more detailed description taken in conjunction with the accompanying drawing, in which.

DETAILED DESCRIPTION OF THE INVENTION

Glossary

We use the following terms, with corresponding definitions, in the description of our invention:

(1) particle: A microscopic body (e.g., an atom or a molecule) or a macroscopic body (e.g., nanocrystals, dust);

(2) multi-pole particle: A particle that has a plurality of electrical poles, both positive and negative;

(3) n-pole particle: A multi-pole particle that has n electrical poles, where $n \geqq 2$ is an integer;

(4) uncharged particle: An n-pole particle in which n is an even integer, and the number of positive charges equals the number of negative charges, so that the particle is electrically neutral;

(5) multi-pole potential: An electric field potential that includes at least two non-zero components having a different number of electrical poles, the components corresponding to the coefficients of a Legendre polynomial expansion of the potential; and (6) n-pole electric field potential component: A component of an electric field potential that has n electrical poles, where n is an even integer; for example, a dipole (n=2); a quadrupole (n=4); a hexapole (n=6); and an octapole (n=8); etc.

Prior Art Traps for Charged Particles (Ions)

Figure 1:
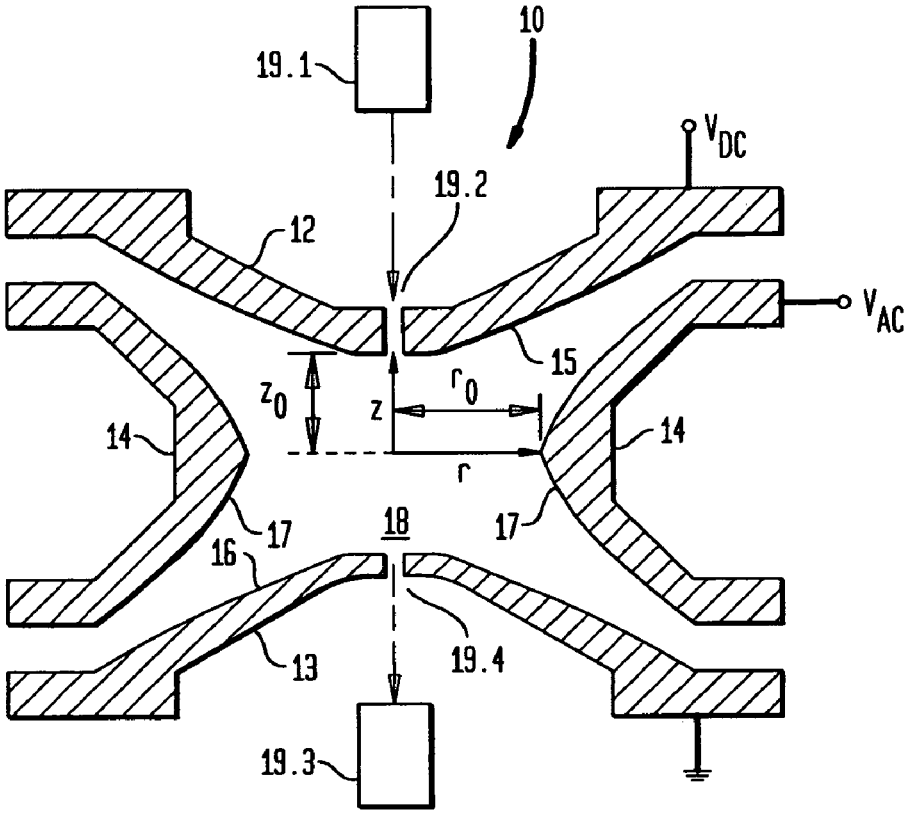
FIG. 1 (PRIOR ART)
FIG. 1 is a schematic, cross sectional view of a prior art ion trap having a hyperbolic macro-cavity.
Figure 2:
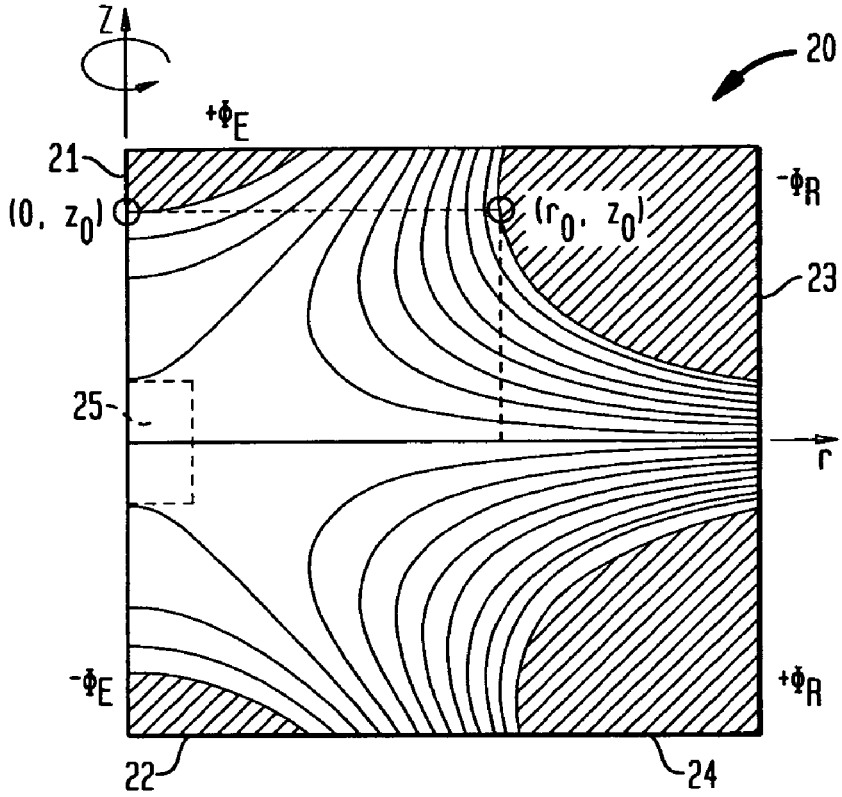
FIG. 2 is a schematic cross-sectional view of a half-plane of a cylindrically symmetric set of four electrodes, which have uniquely curved cross-sections, in accordance with one embodiment of our invention. The figure also shows contour lines of equal potential that create a trapping region 25 within an essentially pure dipole and hexapole potential.

With reference now to FIG. 1, we show a prior art quadrupole ion trap 10 that has an axially symmetric cavity 18 akin to that depicted in FIG. 2 of March, supra. More specifically, the ion trap 10 includes metallic top and bottom end cap electrodes 12-13 and a metallic central ring-shaped electrode 14 that is located between the end cap electrodes 12-13. Points on inner surfaces 15-17 of the electrodes 12-14 have transverse radial coordinates r and axial coordinates z. These coordinates satisfy hyperbolic equations; i.e., $r^2/r_0^2-z^2/z_0^2=+1$ for the central ring-shaped electrode 14 and $r^2/r_0^2-z^2/z_0^2=-1$ for the end cap electrodes 12-13. Here, $2r_0$ and $2z_0$ are, respectively, the minimum transverse diameter and the minimum vertical height of the trapping cavity 18 that is formed by the inner surfaces 15-17. Typical trapping cavities 18 have a shape ratio, $r_0/z_0$ that satisfies: $(r_0/z_0)^2 \approx 2$, but the ratio may be smaller to compensate for the finite size of the electrodes 12-14. Typical cavities 18 have a size that is described by a value of $r_0$ in the approximate range of about 0.707 centimeters (cm) to about 1.0 cm. We refer to cavities of this approximate size as macro-cavities.

For the above-described electrode and macro-cavity shapes, electrodes 12-14 produce an electric field potential with a quadrupole distribution inside trapping cavity 18. One way to produce such an electric field potential involves grounding the end cap electrodes 12-13 and applying a radio frequency (RF) voltage to the central ring-shaped electrode 14. In an RF electric field potential having a quadrupole distribution, ionized particles with small m/q ratios will propagate along stable trajectories. To store particles in the trapping cavity 18, the cavity 18 is voltage-biased as described above, and ionized particles are introduced into the trapping cavity 18 via ion generator 19.1 coupled to entrance port 19.2 in top end cap electrode 12. During the introduction of the ionized particles, the trapping cavity 18 is maintained with a low background pressure; e.g., about $10^{-3}$ Torr of helium (He) gas. Then, collisions between the background He atoms and ionized particles lower the particles' momenta, thereby enabling trapping of such particles in the central region of the trapping cavity 18.

To eject the trapped particles from the cavity 18, a small RF voltage may be applied to the bottom end cap electrode 13 while ramping the small voltage so that stored particles are ejected through exit orifice 19.4 selectively according to their m/q ratios. Alternatively, ions can be ejected by changing the amplitude of the RF voltage applied to the ring electrode 14. As the amplitude changes, different orbits corresponding to different m/q ratios become unstable, and ions are ejected along the z-axis. Ions can also be ejected by application of DC and AC voltages to the end cap electrodes 12-13. In any case, the ejected ions are then incident on a utilization apparatus 19.3 (e.g., an ion collector), which is coupled to orifice 19.4.

For quadrupole ion trap 10, machining techniques are available for fabricating hyperbolic-shaped electrodes 12-14 out of base pieces of metal. Unfortunately, such machining techniques are often complex and costly due to the need for the hyperbolic-shaped inner surfaces 15-17. For that reason, other types of ion traps are desirable.

Figure 1A:
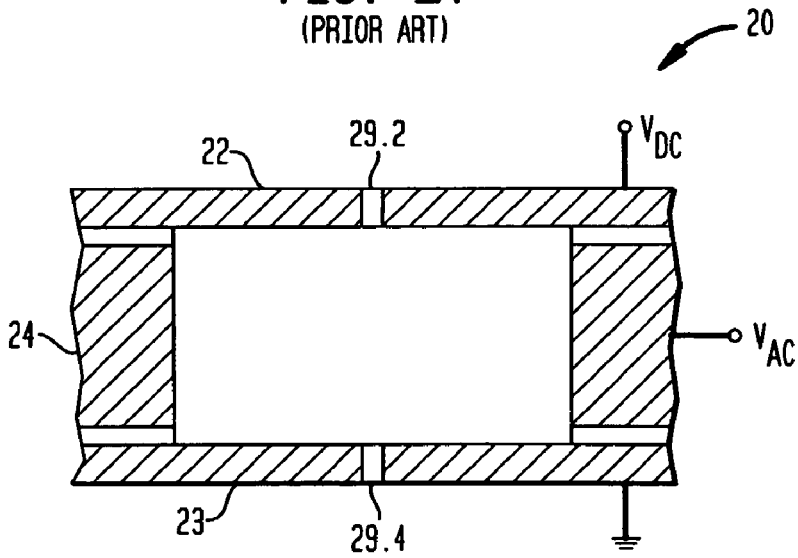
FIG. 1A (PRIOR ART)
FIG. 1A is a schematic, cross sectional view of a prior art cylindrical macro-cavity.

A second type of ion trap 20, as shown in FIG. 1A, has a trapping macro-cavity with a right circularly cylindrical shape. This trapping cavity is also formed by inner surfaces of two end cap electrodes 22-23 and a central ring-shaped electrode 24 located between, but insulated from, the end cap electrodes. Here, the end cap electrodes 22-23 have flat disk-shaped inner surfaces, and the ring-shaped electrode 24 has a circularly cylindrical inner surface. For such a trapping cavity, applying an AC voltage to the central ring-shaped electrode 24 while grounding the two end cap electrodes 22-23 will create an electric field potential that does not have a pure quadrupole distribution. Nevertheless, a suitable choice of the trapping cavity's height-to-diameter ratio will reduce the magnitude of higher multipole contributions to the created electric field potential distribution. In particular, if the height-to-diameter ratio is between about 0.83 and 1.00, the octapole contribution to the field potential distribution is small; e.g., this contribution vanishes if the ratio is about 0.897. For such values of this shape ratio, the effects of higher multipole distribution are often small enough so that the macro-cavity is able to trap and store ionized particles. See, for example, J. M. Ramsey et al., U.S. Pat. No. 6,469,298 issued on Nov. 22, 2002 and M. Wells et al., *Analytical Chem.,* Vol. 70, No. 3, pp. 438-444 (1998), both which are incorporated herein by reference.

For this second type of ion trap, standard machining techniques are available to fabricate the electrodes 22-24 of FIG. 1A from metal base pieces, because the electrodes have simple surfaces rather than the complex hyperbolic surfaces of the electrodes 12-14 of FIG. 1. For this reason, fabrication of this second type of ion trap is usually less complex and less expensive than is fabrication of quadrupole ion traps whose electrodes have hyperbolic-shaped inner surfaces.

More recently C. S. Pai et al. have described cylindrical geometry ion traps with micro-cavities formed in multi-layered semiconductor or dielectric wafers. See, for example, U.S. patent application Ser. No. 10/656,432 filed on Sep. 5, 2003 and U.S. patent application Ser. No. 10/789,091 filed on Feb. 27, 2004, both of which are assigned to the assignee hereof and incorporated herein by reference. In the designs of C. S. Pai et al. the metal electrodes are stacked and separated from one another by insulating, dielectric layers.

Traps for Uncharged Electrical Multi-pole Particles

Figure 8:
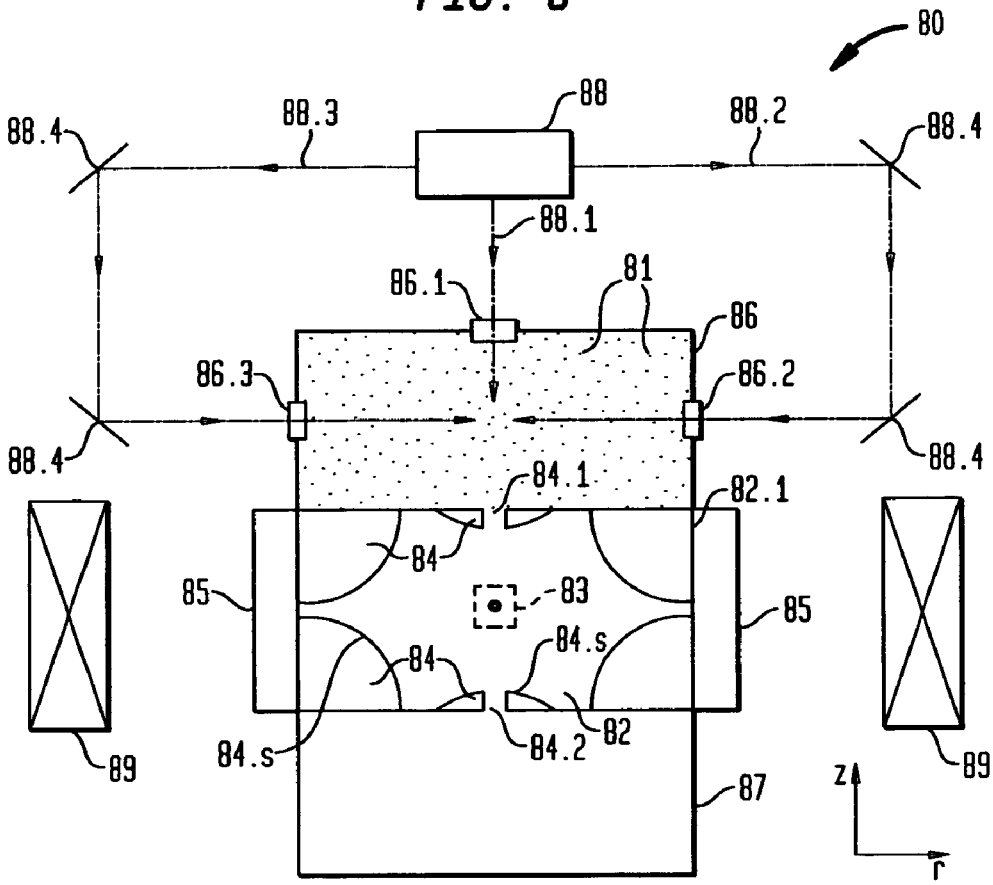
FIG. 8 is a schematic view of a trapping apparatus, in accordance with still another embodiment of our invention.
Figure 9:
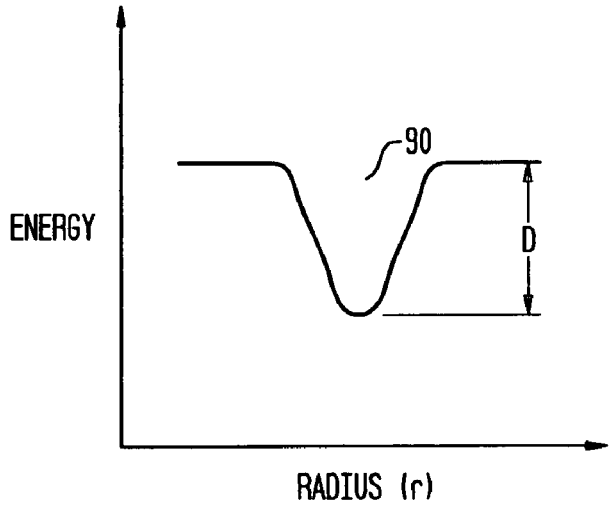
FIG. 9 is a schematic graph of a time averaged potential well formed in a trapping region of a typical bound cavity, in accordance with an illustrative embodiment of our invention.

With reference now to FIG. 8, we show apparatus 80 for trapping uncharged multi-pole particles 81 in the trapping region 83 disposed along the z-axis of a bound cavity 82. The latter is formed within a vacuum chamber 82.1 to reduce collisions between the particles and the ambient. (Such collisions can knock trapped particles out of the stable orbits required for trapping them. On the other hand, such collisions can also cool the particles so that they can be more easily trapped. The trade-off between these two considerations is determined experimentally.) A vacuum of at least $10^{-6}$ Torr is typically established in the chamber. As shown in FIG. 9, the trapping region 83 is a potential well 90 of depth D in the spatial distribution of the energy within the cavity 82. The trapping region 83 is created by applying suitable oscillating (AC) voltages to at least two of a plurality of electrodes 84 coupled to cavity 82 and preferably, but not necessarily, concentric with respect to the z-axis. (The potential well 90 is actually a time average taken over one or more of the sinusoidal cycles of the AC voltage.) Ejection of trapped particles is illustratively achieved by applying suitable DC voltage to other electrodes 84 of the plurality or by suitably altering the applied voltage.

Although FIG. 8 depicts schematically a particular electrode configuration, which is akin to that suitable for trapping/separating uncharged dipole particles, the actual number and shapes of the electrodes depends on exactly what n-pole particles are being trapped/separated, as described more fully below.

The number and shape of the electrodes 84 is designed to produce the desired electric field potential distribution and trapping region within the bound cavity when suitable voltages are applied to the electrodes. In accordance with one aspect of our invention, in order to trap an uncharged multi-pole particle 81, the shape of the electrodes, and in particular the curvatures of their inward facing surfaces 84s, are designed to produce an electric field potential distribution that has a multi-pole first component that forms trapping region 83. The first component is a hexapole or higher order component. Although this design will effectively trap uncharged particles, the design does not straightforwardly allow trapped particles to be ejected from trapping region 83. In particular, the amplitude of the DC voltage to be applied to eject trapped particles would be difficult to determine a priori.

In order to address this issue, in accordance with another aspect of our invention, the curvatures of the inward facing surfaces 84s are designed to produce an electric field distribution that has a multi-pole first component that forms trapping region 83, and the apparatus 80 includes means for aligning the particles 81 predominantly along a predetermined axis within the cavity 82. Aligned particles make the determination of a suitable ejection voltage much simpler. In a preferred embodiment, the aligning means includes electrodes 84 that are also designed to generate within the electric field potential a multi-pole second component that aligns the particles predominantly along the predetermined axis. In this case, it is also preferred that the first component has a higher order, but lower potential, than the second component.

Stated in a slightly different, but equivalent fashion, in order to trap an n-pole ($n \geqq 2$; where n is an even integer) particle the electrodes are shaped to produce an electric field potential distribution that includes an m-pole ($m \geqq n$) second component that aligns the particles predominantly along a particular direction (e.g., the z-axis) within the cavity; and a k-pole ($k>m$) first component that forms trapping region 83. For example, in order to trap a dipole ($n=2$) particle the electrodes are shaped to produce an electric field potential distribution that includes a dipole ($m=2$) second component that aligns the particles along the z-axis; and a hexapole ($k=6$) first component that forms trapping region 83. Preferably, the design produces pure dipole and hexapole distributions; that is, components of other orders (e.g., octapole) are zero or nearly zero. Similarly, in order to trap a quadrupole ($n=4$) particle the electrodes are shaped to produce an electric field potential distribution that includes a quadrupole ($m=4$) second component that aligns the particles along the z-axis; and an octapole ($k=8$) first component that forms trapping region 83. However, because the dipole-quadrupole interaction is known to be non-zero, a dipole component of the electric field potential, rather than a quadrupole component, may be used to align quadrupole particles. Regarding the dipole-quadrupole interaction, see, for example, L. Pauling et al., *Phys. Rev.,* Vol. 47, pp. 686-692 (1935), which is incorporated herein by reference.

In operation, uncharged, multi-pole particles 81 are contained within chamber 86 and propagate (on a random basis) through an input aperture or hole 84.1 in an upper electrode. When suitable voltages are applied to the electrodes, the particles are aligned predominantly along a particular direction (e.g., the z-axis), and some (at least one) uncharged multi-pole particles 81 are trapped in trapping region 83; that is, the trapped particles 81*t* have typical well-known stable orbits within that region. Suitably altering at least one of the voltages applied to the electrodes, or applying a suitable DC voltage across two of them, causes the orbits of the trapped particles to become unstable, thereby causing them to be ejected from the trapping region 83. Once ejected from trapping region 83, some of the ejected particles propagate through an aperture or hole 84.2 in a lower electrode and are then incident on a utilization device 87 (e.g., a particle collector or detector).

Alternatively, an external source 89 of an electromagnetic field may be employed to align the particles predominantly along the predetermined axis. For example, in one embodiment source 89 would generate either a magnetic or an electric field within the bound cavity 82.

In some cases the depth D of the potential well 90 of the trapping region 83 may be comparable to or smaller than the thermal energy of the particles, thereby making the trapping process very inefficient. In those cases, it may be desirable to reduce the kinetic energy of the particles, for example, by cooling the particles before they are injected into the bound cavity 82, and/or by cooling the apparatus 80 (e.g., the electrodes 84 and/or the vacuum chamber 82.1) to cryogenic temperatures (e.g., liquid He temperatures of around 5° K.). Thus, FIG. 8 shows a cryostat 85 surrounding the vacuum chamber 82.1 to cool the electrodes, the chamber and the cavity to a suitable cryogenic temperature. If even colder temperatures (e.g., 1 m° K.) are necessary, a well-known dilution refrigerator may be substituted for the cryostat 85.

Alternatively, or in addition, the particles may be subjected to laser cooling, as described, for example, by C. C. Bradley et al., *Experimental Meth. Phys. Sci.,* Vol. 29B, pp. 129-144 (1996), which is incorporated herein by reference. In the latter case, the output beam of a laser 88 is split into multiple beams 88.1, 88.2, 88.3, which are directed by reflectors 88.4 into different windows 86.1, 86.2, 86.3 of input chamber 86 in which the particles are initially contained. The laser beams have a wavelength that corresponds to an optical transition of the particles 81 to be trapped. Alternatively, of course, separate lasers may be used to generate the desired number of beams.

Instead of the cooling approaches described above, or in addition thereto, the depth D of the potential well can be increased by reducing the physical size of the trap and/or by increasing the amplitude of the operating voltage.

Traps for Uncharged Electrical Dipole Particles

In this illustration, we describe a technique to trap and separate uncharged molecules in gaseous form by their dipole moment (p) over mass (m) ratio (p/m). The technique can be combined with existing analytical tools and can also be generalized to separate uncharged molecules and atoms of higher order moment.

We begin by considering the idealized situation of an electrically neutral dipole molecule in a pure dipole and hexapole potential. The potential $\phi$ is given by equation (1):

$$\phi = \sum_{n=0}^{\infty} A_n \rho^n P_n(\cos\theta) = A_0 + A_1 z + A_3 z\left(\frac{3}{2}r^2 - z^2\right), \tag{1}$$

where $A_n$ are weighting factors, $\rho=\sqrt{r^2+z^2}$, and $P_n(\cos\theta)$ are Legendre polynomials. In the presence of this potential, the dipole experiences both a force and a torque. Assuming the potential varies slowly in space over the region of the dipole, the force (F) and torque (N) are given by equations (2) and (3), respectively:

$$F = m\begin{bmatrix} \partial^2 x/\partial t^2 \\ \partial^2 y/\partial t^2 \\ \partial^2 z/\partial t^2 \end{bmatrix} = (-3A_3)\begin{bmatrix} p_z & 0 & p_x \\ 0 & p_z & p_y \\ p_x & p_y & p_z \end{bmatrix}\begin{bmatrix} x \\ y \\ z \end{bmatrix}, \tag{2}$$

and $$N = (-3A_3)\begin{bmatrix} 0 & \frac{A_1}{3A_3} + \frac{x^2+y^2}{2} - z^2 & -yz \\ \frac{-A_1}{3A_3} - \frac{x^2+y^2}{2} + z^2 & 0 & xz \\ yz & -xz & 0 \end{bmatrix}\begin{bmatrix} p_x \\ p_y \\ p_z \end{bmatrix}, \tag{3}$$

where $\bar{p}=(p_x, p_y, p_z)$ is the dipole moment. For the case where the contribution from the dipole potential is greater than the hexapole potential, i.e., $A_1 >> A_3 z_0^2$, where $z_0$ is some characteristic dimension of the trap potential, the dipole of the molecule will be forced to align along the z-axis, and $p_x \cong p_y \cong 0$. The force matrix is diagonal, and we can solve the trajectory of the dipole by considering only one component of the force. (We note that the matrix can always be diagonalized in the eigenvector coordinates.)

Figure 2A:
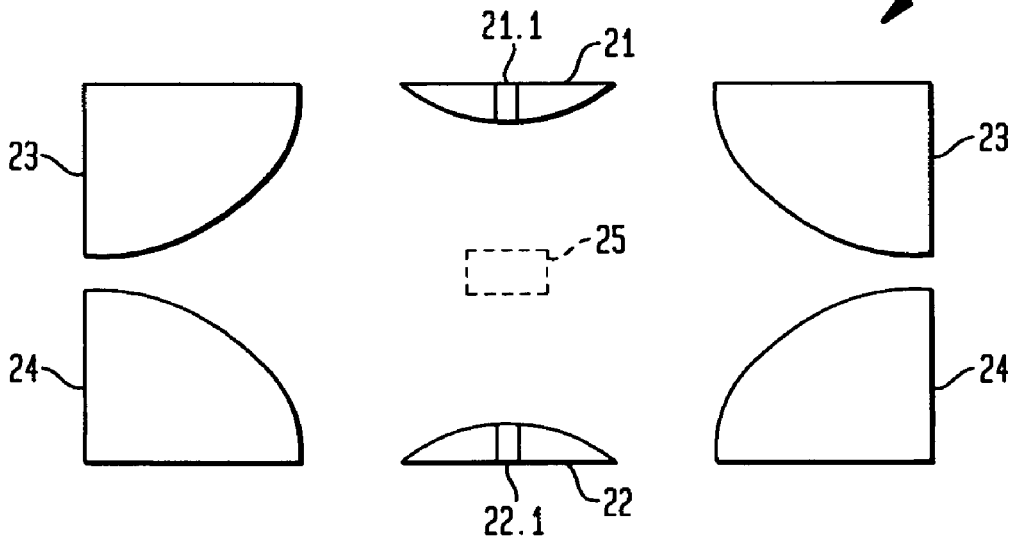
FIG. 2A is a schematic cross-sectional view of the cylindrically symmetric set of four electrodes of FIG. 2, which are formed by rotation of the half-plane of FIG. 2 about the z-axis.

Next, we consider a configuration 20 of four electrodes 21-24 to generate the dipole and hexapole potentials, as shown in FIGS. 2-2A. For simplicity only, the electrodes are chosen to be cylindrically symmetric. The shapes of the electrodes are determined by the condition that the potential given by equation (1) is a constant. The potentials for the upper and lower disk-shaped electrodes 21-22 are defined as $\pm\phi_E$, and the potentials for the annular electrodes 23-24 are defined as $\pm\phi_R$.

In general, suitable voltages are oscillating (AC) voltages (and in some cases DC voltages) $+\phi_R$ and $-\phi_R$ applied to the upper and lower annular electrodes 23-24, respectively, and DC voltages $-\phi_E$ and $+\phi_E$ applied to the upper and lower disk-like electrodes 21-22, respectively. In order to align the particles entering port 21.1, $\phi_R$ and $\phi_E$ are both turned on. The dipole component of the electric field potential aligns the dipole particles predominantly along a predetermined direction. Illustratively, and to simply the analysis and design, the alignment direction corresponds to the common axis of the concentric electrodes, but in general could be any other direction, depending on the design of the electrodes. Once the particles are aligned, which typically happens by transferring angular momentum during collisions with other particles, equilibrium is reached, and then $\phi_E$ is set to zero in order to trap particles in trapping region 25, where the particles have stable orbits. Finally, in order to eject particles from the trapping region 25 they are driven into unstable orbits, which may be caused by turning on $\phi_E$ again or by changing the amplitude or frequency of $\phi_R$. Ejected particles exit via port 22.1.

Returning now to equations (1)-(3), we have chosen $A_1=\alpha A_3 z_0^2$ for convenience, where $\alpha$ is a dimensionless proportionality constant. Then, the coefficients $A_n$ can be expressed in terms of the electrode potentials as indicated in equations (4)-(6) below:

$$A_0 = \phi_E + (\alpha - 1)\frac{2z_0^2(\phi_E + \phi_R)}{3r_0^3}, \quad (4)$$

$$A_1 = -\frac{2\alpha z_0}{3r_0^2}(\phi_E + \phi_R), \text{ and} \quad (5)$$

$$A_3 = -\frac{2(\phi_E + \phi_R)}{3r_0^2 z_0} \quad (6)$$

where $A_0$ is the DC component, $A_1$ is the dipole component, and $A_3$ is the hexapole component. These coefficients enable us to design suitably shaped electrodes. For the trapping of a dipole, we set $\phi_E=0$ and $\phi_R=U+V\cos(\Omega t)$. The equation of particle motion has the form of the Mathieu equation (7):

$$\frac{d^2 u_0}{d\xi^2} + [a_u - 2q_u\cos(2\xi)]u_0 = 0 \quad (7)$$

which was developed around 1870s to describe the motion of vibrating membranes and is also used extensively in mass spectrometry to describe the motion of an ion trapped inside a quadrupole potential. By setting $\xi=\Omega t/2$, we have the stability parameters of equations (8) and (9), as described in by R. E. March et al., *Practical Aspects of Ion Trap Mass Spectrometry,* Vol. 1, p. 33, CRC Press (1995), which is incorporated herein by reference:

$$a = \frac{-8pU}{mr_0^2 z_0 \Omega^2} \text{ and} \quad (8)$$

$$q = \frac{4pV}{mr_0^2 z_0 \Omega^2}. \quad (8)$$

We see that a dipole in a hexapole potential can be described by the Mathieu equation and can form a stable trajectory. Dipoles having different p/m ratios have different trajectories and, therefore, can be separated from one another by changing the values of U, V and Ω. As mentioned previously, the presence of the dipole potential is used to align the dipole moment. Molecules with dipole moments will orient along the dipole direction, which is not necessarily along the molecular axis. If the mass of the molecule is known, for example from conventional mass spectrometry, the value of the dipole moment can be determined. In order for the molecule to stay in the trap, the depth (D) of the potential well must be greater than the initial thermal energy of the molecule; that is, $$D_r = \frac{qpV}{6er_0} \geq \frac{k_B T}{e} \text{ and} \quad (9)$$

$$D_z = \frac{3qpV}{8er_0} \geq \frac{k_B T}{e} \quad (10)$$

where we assume $3r_0=2z_0$, an arbitrary choice that enables us to eliminate one variable. A typical molecular dipole moment ranges from 1 to 5 debye. For a macroscopic trap size, $r_0$=1-10 mm, and a dipole of one debye, the trap potential depth is rather small, much below the thermal energy at room temperature. Therefore, the molecule should be initially cooled, or the trap depth increased, as previously described, in order to be trapped.

Figure 3:
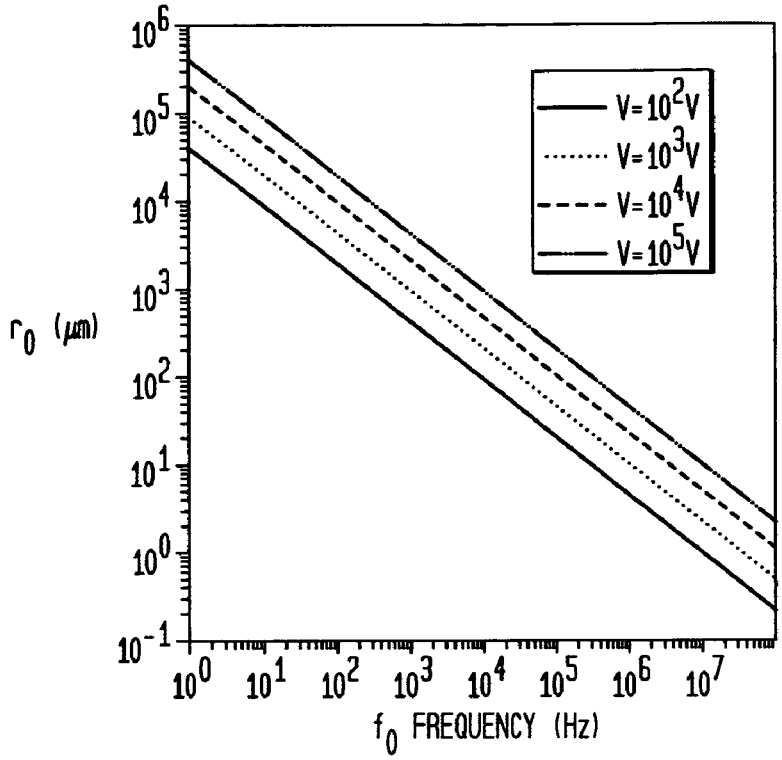
FIGS. 3 & 4 are log-log plots of trap radius $r_0$ versus operating frequency $f_0$ (FIG. 3) and depth potential D versus $r_0$ (FIG. 4)
Figure 4:
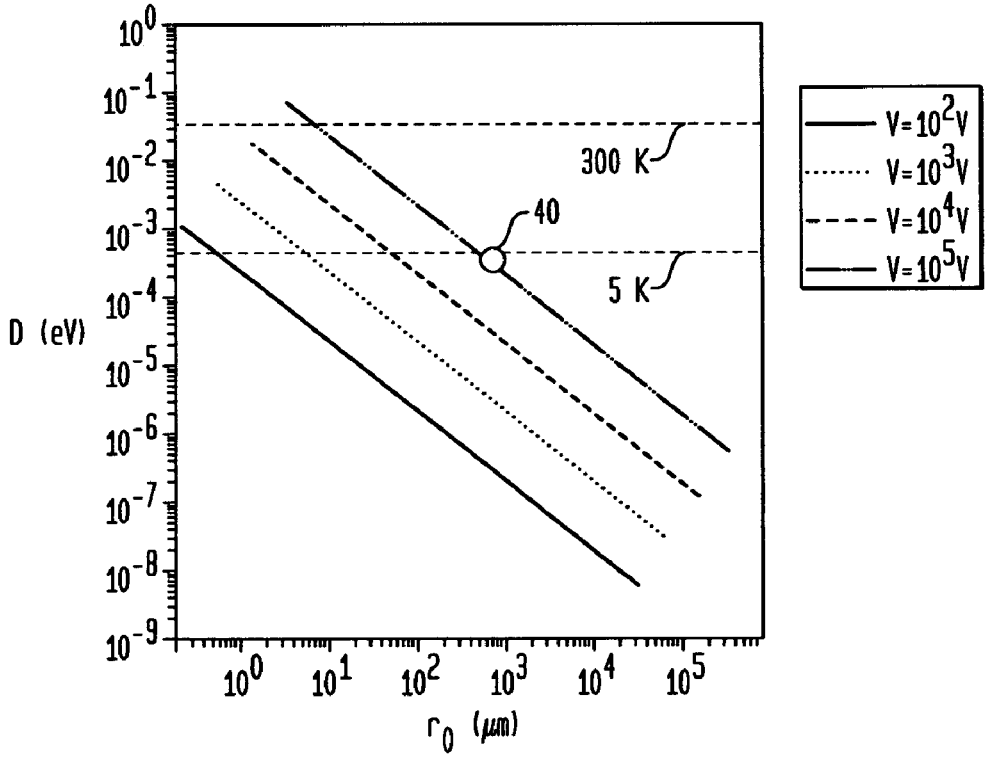

FIGS. 3-4 show the scaling relationships among several parameters: the size of the trap ($r_0$), the operating frequency ($f_0$) (i.e., the frequency of the oscillating signal applied to the annular electrodes 23-24 of FIGS. 2-2A), and the depth (D) of the trap potential for one set of parameters: m=200 Daltons, q=0.7,p=1 debye, U=0 for different values of the operating voltage V (i.e., the peak-to-peak voltage amplitude V of the oscillating signal applied to the electrodes). We see that for a trap of size of 1-10 mm ($10^3$-$10^4$ μm), the operating frequency is around the kilohertz range (e.g., 13-22 kHz). Depending on the operating voltage, a trap of this size has a trap depth D of the order of 10 μeV (i.e., $10^{-5}$ eV), which is below the thermal energy of the particles at room temperature. Therefore, such a trap would not be efficacious for operation at room temperature. (The circle 40 of FIG. 4 indicates the conditions where $D=4.3\times10^{-4}$ eV~kT/q at 5° K. for the case where $f_0$=10 kHz, $r_0$=1 mm=$10^3$ μm, and V=$10^5$ V.)

To be an effective trap, the kinetic energy of the molecules should be initially reduced, and the trap should be formed in a high vacuum to reduce electrical breakdown due to the high electric field and the likelihood of collisions between the ambient and the particles to be trapped/separated. In addition, the depth of the potential well can be increased by reducing the size of the trap and by increasing the operating voltage. However, the thermal energy requirement can also be reduced by cooling the gas (e.g., by laser cooling), and/or by cooling the electrodes and the vacuum enclosure to a cryogenic temperature (e.g., 5° K., the approximate temperature of liquid He). At this temperature the trap depth $D\sim4.3\times10^{-4}$ eV, which is approximately equal to the thermal energy of the particles at the same temperature.

To obviate the need for cooling the gas, we consider the following alternative. Field emission for typical electrode metal occurs around $5\times10^7$ V/cm, which puts a limit on the maximum field inside the trap to prevent undesirable avalanche breakdown. Assuming we can operate at a low pressure and temperature, and further assuming the metal is coated with a layer of an insulator (e.g., diamond) to reduce field emission, we can achieve a trap potential of the order of the thermal energy by applying a voltage of $10^5$ V at 10 kHz on a hexapole trap of one millimeter radius. The electric field inside such a trap would be about $10^6$ V/cm, which is lower than the dielectric breakdown voltage ($E_B$) of diamond ($E_B\sim10^7$ V/cm). The integration of such a system implies the ability to produce a high field, high vacuum and low temperature within a confined space.

Based on dimensional analysis, we note that the force on a dipole is proportional to the second spatial derivative of the potential. See, J. D. Jackson, *Classical Electrodynamics,* $2^{nd}$ ed., p 164, John Wiley & Sons, New York (1975), which is incorporated herein by reference. To generate a force that is linearly proportional to the coordinate, which can be used for trapping and can be put in the form of the Mathieu equation, we need a hexapole potential. Similarly, the force on a quadrupole is proportional to the third spatial derivative of the potential, and we need an octapole potential to trap a quadrupole particle. In general, we can utilize an (n+4)-pole potential to trap an n-pole particle.

Moreover, the use of a hexapole potential is not limited to trapping molecules. Since the depth of the trap potential scales linearly with the dipole moment, it is easier to trap particles with dipole moments larger than that of a typical molecular dipole. It is also possible to extend our analysis to include the trapping and separation of dipole particles in either a dilute gas or possibly even in a liquid, such as deionized water. See, for example, M. Z. Bazant et al., *Phys. Rev. Lett.,* Vol. 92, No. 6 pp. 066101-(1-4) (2004), which is incorporated herein by reference. The addition of a drag term to the force equation, which can be put in the form of the Mathieu equation, enlarges the dipole and mass dependent stability region, a result similar to that found for an ion in a quadrupole trap. See, for example, W. B. Whitten et al., *Rapid Commun. Mass Spectrom.,* Vol. 18, pp. 1749-1752 (2004), which is incorporated herein by reference.

Alternative Traps for Uncharged Electrical Dipole Particles

Figure 5:
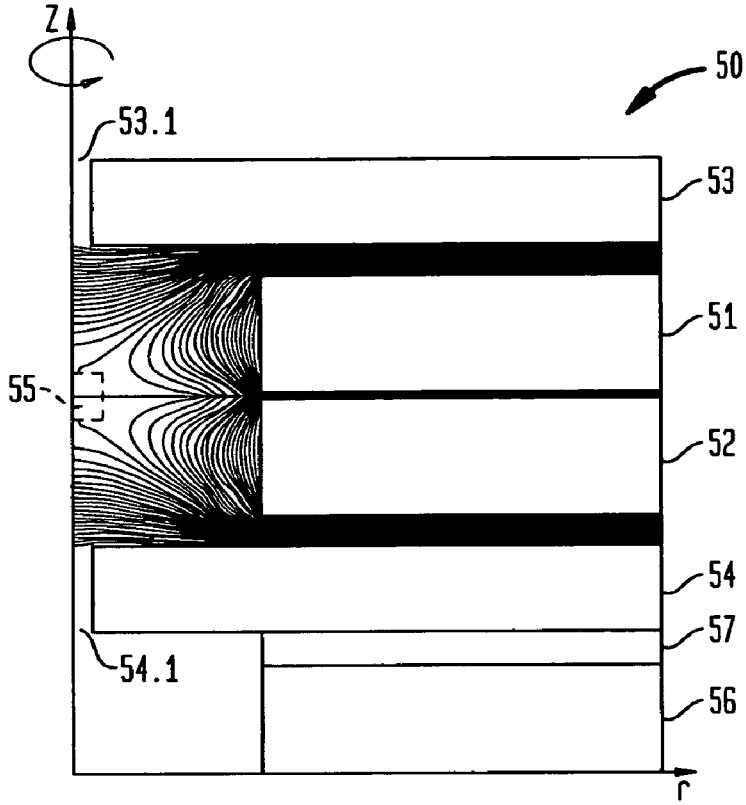
FIG. 5 is a schematic cross-sectional view of a half-plane of a cylindrically symmetric set of four electrodes, which have rectangular cross-sections, in accordance with one embodiment of our invention. The figure also shows contour lines of equal potential that create an alternative trapping region 55 within a dipole and hexapole potential.

The analysis so far has concentrated on electrodes that have curved inner surfaces shaped like the potential function. In practice, it is possible to generate an approximate hexapole potential using different electrode shapes, which are simpler to fabricate and to miniaturize. FIGS. 5-7 show examples of electrode configurations that can generate the dipole and hexapole potentials of interest. Geometries include a trap 50 having cylindrically shaped electrodes (FIGS. 5-5A), a trap 60 having an array of rod-like electrodes (FIGS. 6-6A), and a trap 70 having a pair of toroidal electrodes (FIGS. 7-7A). FIGS. 5, 6 and 7 show the equal potential contours, which were calculated using finite element analysis. The apertures or holes in the top and bottom end cap electrodes serve as entrance and exit ports for the dipole particles. The separation of the end cap electrodes can be increased from the ideal case to compensate for the presence of the holes.

Figure 5A:
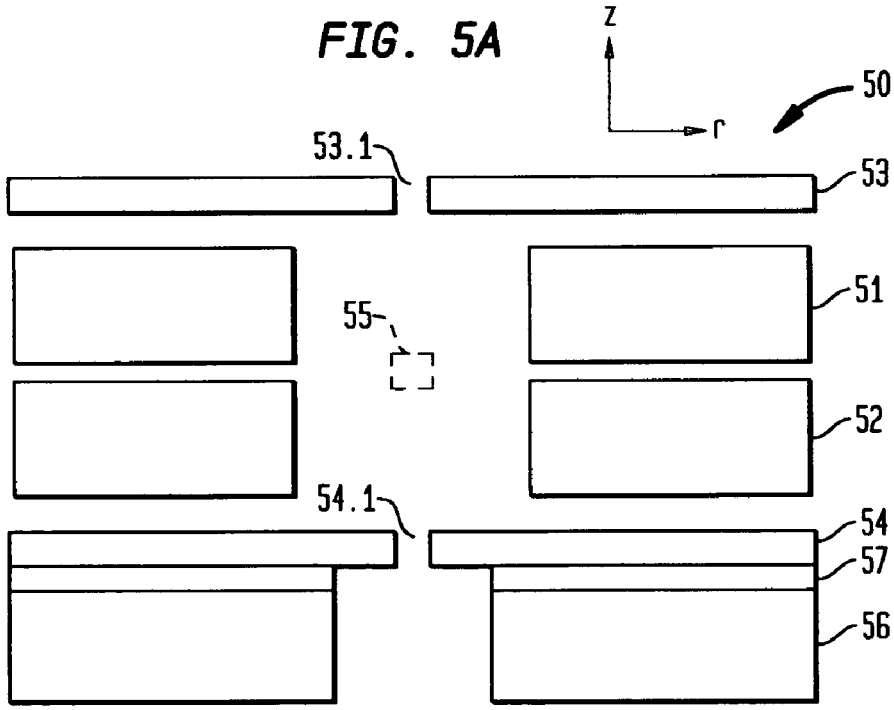
FIG. 5A is a schematic cross-sectional view of the cylindrically symmetric set of four electrodes of FIG. 5, which are formed by rotation of the half-plane of FIG. 5 about the z-axis.
Figure 6:
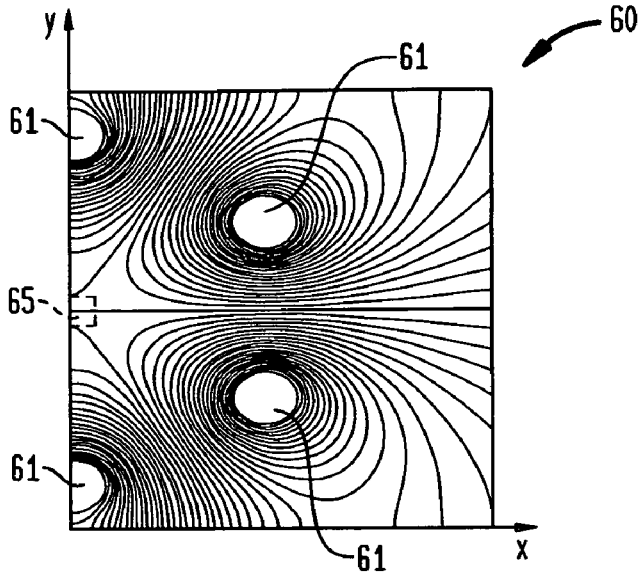
FIG. 6 is a schematic top view of a half-plane of a symmetric set of six rod-like electrodes, which have circular cross-sections, in accordance with one embodiment of our invention. The figure also shows contour lines of equal potential that create another alternative trapping region 65 within a dipole and hexapole potential.

More specifically, in the embodiment of FIGS. 5-5A the bound cavity (not shown) includes upper and lower circularly cylindrical concentric disk-shaped electrodes 53, 54 and, concentrically disposed therebetween, a pair of concentric annular electrodes 51, 52. A cylindrical structure, but having only one annular electrode, in an ion trap mass spectrometer is described by J. M. Wells et al., supra. The lower electrode 54 is carried by a conductive substrate 56 but is separated therefrom by an electrically insulating layer 57. With suitable voltages applied to the electrodes, a trapping region 55 is formed within the cavity. Uncharged dipole particles enter through port 53.1 and, after being ejected from the trap by suitable alteration of the applied voltages, exit through port 54.1 to a utilization device (not shown).

Figure 6A:
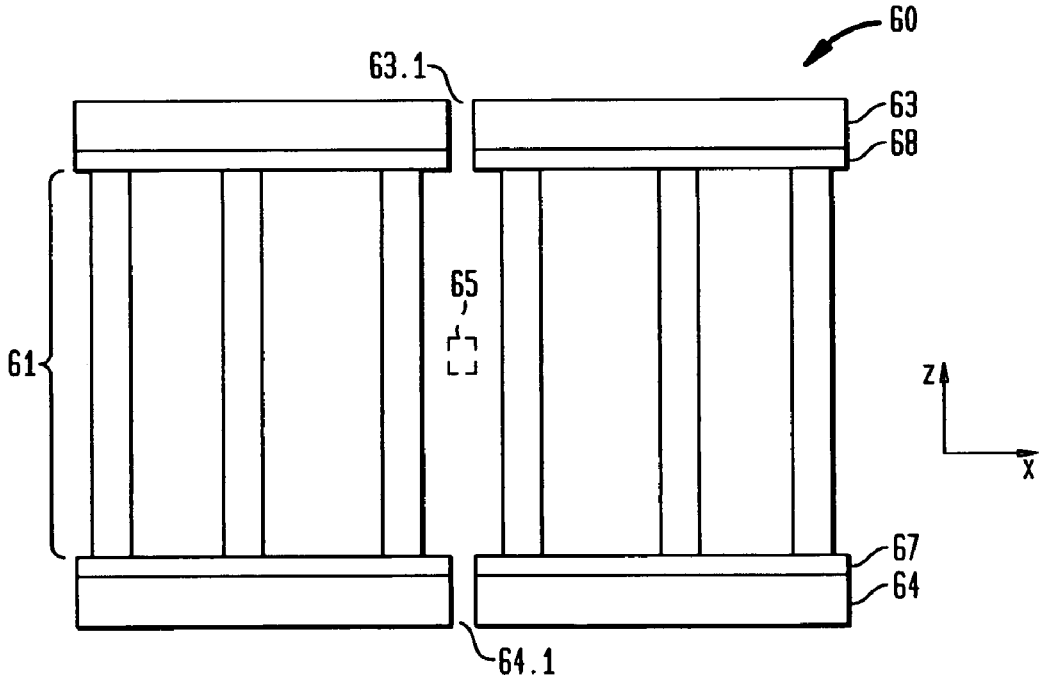
FIG. 6A shows a schematic side view of an electrode structure of the type shown in FIG. 6 formed, in part, by reflecting the half-plane of FIG. 6 from the y-axis. However, in FIG. 6A the position of the rods has been altered so that all six are visible.
Figure 7:
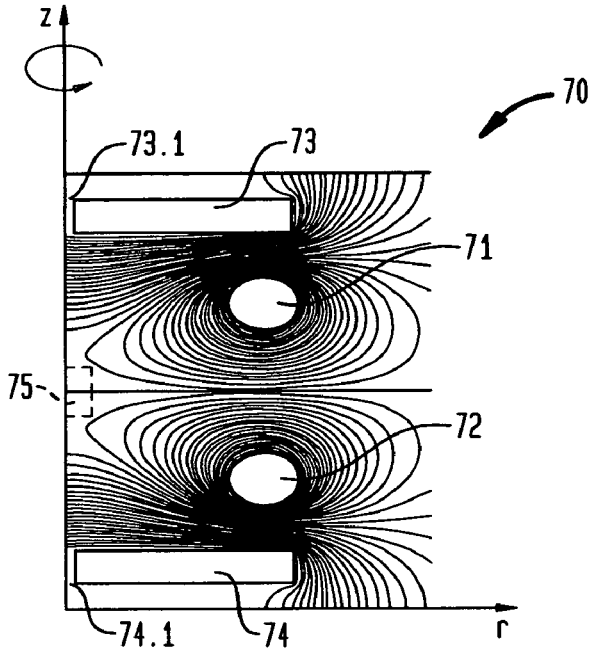
FIG. 7 is a schematic cross-sectional view of a half-plane of an electrode structure, which includes a pair of toroidal electrodes disposed between a pair of annular electrodes, in accordance with one embodiment of our invention. The figure also shows contour lines of equal potential that create yet another alternative trapping region 75 within a dipole and hexapole potential.
Figure 7A:
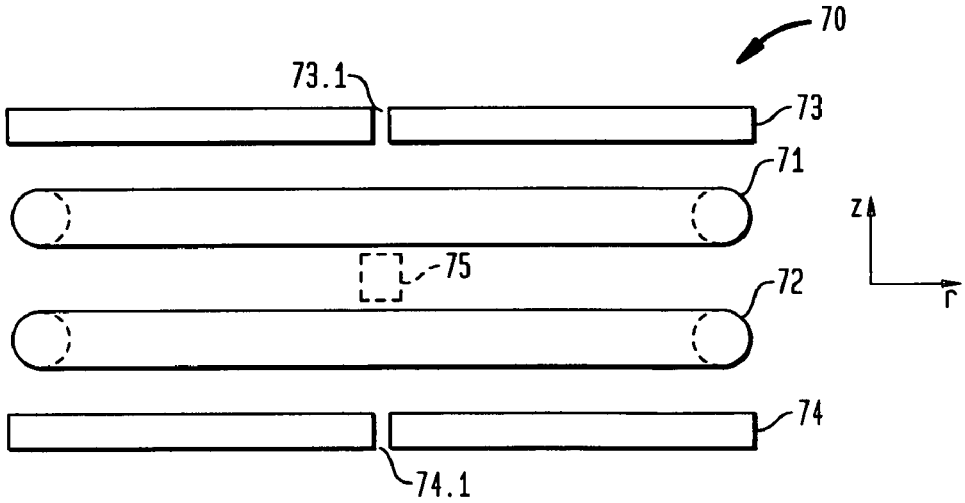
FIG. 7A is a schematic, side view of an electrode structure of the type shown in FIG. 7 formed by rotation of the half-plane of FIG. 7 about the z-axis.

In the embodiment of FIGS. 6-6A the bound cavity (not shown) includes upper and lower circularly cylindrical concentric disk-shaped electrodes 63, 64 and, concentrically disposed therebetween, a multiplicity of parallel rod-like electrodes 61. (Six such electrodes are shown for the case of trapping/separating uncharged dipole particles, in which case the rod-like electrodes are preferably positioned in the x-y plane at the apexes of a hexagon.) The upper and lower electrodes 63, 64 are separated from the rod-like electrodes 61 by electrically insulating layers 68, 67, respectively. With suitable voltages applied to the electrodes, a trapping region 65 is formed within the cavity. Uncharged dipole particles enter through port 63.1 and, after being ejected from the trap by suitable alteration of the applied voltages, exit through port 64.1 to a utilization device (not shown).

Although the rod-like electrodes 61 are illustratively depicted as being right circular cylinders, their cross-sections could have other shapes; e.g., irregular shapes or geometric shapes such as ovals or polygons.

In the embodiment of FIGS. 7-7A the bound cavity (not shown) includes upper and lower circularly cylindrical concentric disk-shaped electrodes 73, 74 and, concentrically disposed therebetween, a pair of concentric toroidal electrodes 71, 72. Preferably the diameter of the toroidal electrodes 71, 72 is approximately equal to the diameter of the disk-shaped electrodes 73, 73. With suitable voltages applied to the electrodes, a trapping region 75 is formed within the cavity. Uncharged dipole particles enter through port 73.1 and, after being ejected from the trap by suitable alteration of the applied voltages, exit through port 74.1 to a utilization device (not shown).

It is to be understood that the above-described arrangements are merely illustrative of the many possible specific embodiments that can be devised to represent application of the principles of the invention. Numerous and varied other arrangements can be devised in accordance with these principles by those skilled in the art without departing from the spirit and scope of the invention. In particular, our invention can be implemented in either macro-cavity or micro-cavity form. For example, the embodiment of FIG. 2A is more amenable to macro-cavity design since the complex curvature of the electrodes may be easier to realize by metal machining techniques known in the mechanical arts than by patterned etching techniques of the integrated circuit arts. On the other hand, the simpler geometric shapes of the embodiments of FIGS. 5A-7A may be more amenable to micro-cavity design. In addition, there are several advantages in miniaturizing the apparatus. A reduction in size may offer advantages in reducing the operating power and increasing the operating pressure, akin to those recognized in the field of quadrupole ion trap mass spectrometry. See, for example, W. B. Whitten, supra, and E. R. Badman et al., *J. Mass. Spectrom.,* Vol. 35, No. 6, pp. 659-671 (2000), which is incorporated herein by reference. However, it is well known that the effect of gas breakdown and field emission becomes important when high applied voltages are used in devices having the small dimensions typified by micro-cavity designs.

We claim:

1. A method comprising the steps of:

(a) introducing a plurality of uncharged multi-pole particles into a bound cavity having an axis and a trapping region disposed along the axis, (b) aligning the particles predominantly along a predetermined axis within the cavity, and (c) applying oscillating voltage to the cavity to generate therein an electric field potential that includes a multi-pole first component that forms the trapping region.

2. The method of claim 1, wherein step (b) includes generating an electric field potential that also includes a lower order, and higher potential, multi-pole second component that aligns the particles predominantly along the predetermined axis.

3. The method of claim 2, further including the step of:

(d) altering a parameter of the oscillating voltages so as to eject trapped particles from the cavity.

4. The method of claim 2, wherein step (a) introduces uncharged n-pole particles into the cavity, and step (c) generates the multi-pole first component as an (n+4)-pole component, where $n \geqq 2$ is an even integer.

5. The method of claim 4, wherein step (a) introduces uncharged dipole particles into the cativy, and step (b) generates the (n+4)-component as a hexapole component.

6. A method comprising the steps of:

(a) introducing a plurality of uncharged multi-pole particles into a bound cavity having an axis and a trapping region disposed along the axis, and (b) applying oscillating voltage to the cavity to generate therein an electric field potential that includes a multipole first component that forms the trapping region, said first component being generated as a hexapole or higher order component.

7. The method of claim 6, further including the step of aligning the uncharged particles predominantly along a predetermined axis within the cavity.

8. The method of claim 7, wherein the aligning step includes producing in the electric field potential a multi-pole second component that aligns the particles predominantly along the predetermined axis.

* * * * *